US009452508B2

(12) United States Patent
Beechinor et al.

(10) Patent No.: US 9,452,508 B2
(45) Date of Patent: Sep. 27, 2016

(54) ADJUSTABLE KNIFE HOLDER ADAPTED TO MAINTAIN SHARPNESS OF A KNIFE BLADE AND METHOD OF MANUFACTURING THE ADJUSTABLE KNIFE HOLDER

(71) Applicant: BAR 3 PRODUCTS GROUP, LLC, Poway, CA (US)

(72) Inventors: James Leonard Beechinor, Fresno, CA (US); Terrence Anderson Blanco, Poway, CA (US); Karen Louise Pascoe, Rocklin, CA (US); Nam Quoc Hoang, San Diego, CA (US)

(73) Assignee: Bar 3 Products Group, LLC, Poway, CA (US)

( * ) Notice: Subject to any disclaimer, the term of this patent is extended or adjusted under 35 U.S.C. 154(b) by 185 days.

(21) Appl. No.: 13/950,120

(22) Filed: Jul. 24, 2013

(65) Prior Publication Data

US 2015/0031274 A1 Jan. 29, 2015

(51) Int. Cl.
*B24D 15/08* (2006.01)

(52) U.S. Cl.
CPC ..... *B24D 15/084* (2013.01); *B24D 15/081* (2013.01); *Y10T 29/4984* (2015.01)

(58) Field of Classification Search
CPC .... B24B 3/54; B24D 15/065; B24D 15/081; B24D 15/084
USPC ..... 451/45, 321, 552, 553; 30/138
See application file for complete search history.

(56) References Cited

U.S. PATENT DOCUMENTS

| | | | | |
|---|---|---|---|---|
| 2,559,273 | A | 7/1951 | Brinkley | |
| 2,767,530 | A * | 10/1956 | Paldanius | 451/555 |
| 3,861,246 | A * | 1/1975 | Waller | B24D 15/081 30/138 |
| 4,229,910 | A | 10/1980 | McRae | |
| 4,494,339 | A | 1/1985 | Pittaway | |
| 4,550,632 | A | 11/1985 | Inman | |
| 4,627,194 | A | 12/1986 | Friel | |
| 4,654,968 | A | 4/1987 | Gatley et al. | |
| 4,794,738 | A * | 1/1989 | Brignoli | 451/486 |
| 4,799,335 | A | 1/1989 | Battocchi | |
| 4,869,027 | A * | 9/1989 | McEvily | B26B 29/025 30/138 |
| 5,009,040 | A * | 4/1991 | Petroff | 451/555 |
| 5,121,659 | A * | 6/1992 | Williams | 76/86 |
| 5,390,431 | A | 2/1995 | Friel | |
| 6,224,475 | B1 * | 5/2001 | May | B24D 15/084 30/298.4 |
| 7,854,650 | B2 | 12/2010 | Tsai | |
| 8,262,438 | B1 | 9/2012 | Allison et al. | |
| 2007/0281590 | A1 * | 12/2007 | Friel et al. | 451/45 |

(Continued)

FOREIGN PATENT DOCUMENTS

EP 0665086 A1 * 8/1995

*Primary Examiner* — Monica Carter
*Assistant Examiner* — Marcel Dion
(74) *Attorney, Agent, or Firm* — Jerry R. Potts; James R. McDaniel

(57) ABSTRACT

Adjustable knife holder adapted to maintain sharpness of a knife blade and method of manufacturing the knife holder. The knife holder comprises a housing defining an interior volume therein and a sharpener disposed in the interior volume for slightly sharpening the knife blade each time the knife blade is inserted into or withdrawn from the holder, thereby obviating a need to periodically resharpen the knife blade. The sharpening component can be conveniently removed and interchanged with another sharpener for maintaining sharpness of various types, styles and sizes of knives.

19 Claims, 12 Drawing Sheets

(56) References Cited

U.S. PATENT DOCUMENTS

| | | | | |
|---|---|---|---|---|
| 2009/0056503 | A1 | 3/2009 | Friesen et al. | |
| 2009/0233530 | A1 | 9/2009 | Friel, Sr. et al. | |
| 2011/0201257 | A1 | 8/2011 | Walker | |
| 2011/0244766 | A1 | 10/2011 | Smith et al. | |
| 2011/0244767 | A1 | 10/2011 | Elek et al. | |
| 2012/0180602 | A1* | 7/2012 | Murphy et al. | 76/82 |

* cited by examiner

ADJUSTABLE KNIFE HOLDER ADAPTED TO MAINTAIN SHARPNESS OF A KNIFE BLADE AND METHOD OF MANUFACTURING THE ADJUSTABLE KNIFE HOLDER

FIELD OF THE INVENTION

The present invention generally relates to abrading apparatus and methods and more particularly relates to devices for sharpening knives by abrasion and methods of manufacturing such devices.

BACKGROUND OF THE INVENTION

Knives have long been used for many purposes in various environments, such as paring knives used in home kitchens, butcher knives and cleavers used in butcher shops, multi-tool or utility knives used as box cutters in warehouses, survival knives used by outdoorsmen and having a hollow handle for storing equipment, surgical knives used in surgical procedures, special purpose knives (e.g., plastic, wood and ceramic) to avoid detection by metal sensing equipment, and many other types and sizes of knives for a multiplicity of uses.

In any of the environments mentioned hereinabove, it is important that knives be maintained in a sharpened state. The terminology "sharpen", "sharpened", "sharpening" and variants thereof is defined herein to mean the process of regrinding a knife blade edge or the state of having a reground knife blade edge, preferably ground to the blade edge's original angle, if known. It is important to maintain knives in a sharpened state because a dull knife is more difficult to control when being used and, therefore, may slip and injure the user. In this regard, a user will apply more pressure to compensate for the dullness of the knife. Application of more pressure can lead to loss of control of the knife that, in turn, can lead to injury. Also, a dull knife requires more effort on the part of the user because a dull knife requires more pressure to cut an item. In this case, repeated cutting with a dull knife will be more tiring for the user compared to cutting with a sharp knife. In addition, a dull knife can leave a jagged edge on the item being cut. In the case of food preparation, the jagged edge can cause uneven cuts when the user is attempting to make thin cuts. Using dull knives may even present a health risk when cutting food, such as raw fish items (e.g., sushi and shell fish), oysters, clams and mussels. For example, shell fish can carry *vibrio* bacteria that can lead to "*vibrio-cholerae*", which is a cholera-related, gastrointestinal illness. Such a cholera-related, gastrointestinal illness can present a serious health risk to persons having immune-deficiency health issues. More specifically, the uneven edge of a dull knife blade will leave a jagged edge in the fish item being cut. Such a jagged edge is more prone to collect populations of bacteria thereat. Ingestion of the raw fish containing the bacteria can increase the afore-mentioned health risk.

Therefore, it is important that the cutting edge of a knife be sharp to avoid risk of injury, unnecessary exertion, and risks to human health. It is also important that, once sharpened, the knives be maintained in a sharpened condition.

However, as known by persons of ordinary skill in the art of abrading devices, maintaining knives in a sharpened condition has proven to be challenging. For example, soft stainless steel knives, which are found in many retail stores, are difficult to sharpen. Hence, soft stainless steel knives are more difficult to maintain in a sharpened state. Also, some knives when washed in a dishwasher using dishwashing soap or detergent can develop a dull cutting edge over time, unless periodically resharpened. Also, leaving a knife in a pan of soapy water can develop a dull cutting edge over time, unless periodically resharpened. Loose storage of the knife, such as being loosely stored in a drawer and having the blade portion exposed rather than being individually separated and sheathed, can cause impact damage to the knife blade. Impact damage to the knife blade can also create a dull cutting edge over time, unless periodically resharpened.

Another challenge to suitably sharpening knives is knives are manufactured in widely varying styles, sizes, shapes, blade materials, blade hardness, blade contour, and blade facet angle. For example, with regard to blade angle, knives are typically manufactured having at least one of two well-known blade angles. More specifically, Euro-American style blades typically have a manufactured included V-shaped blade angle of 20° in transverse cross-section. Asian style knives, on the other hand, have a manufactured included V-shaped blade angle of between about 12° and about 15° in transverse cross-section. Therefore, a user having both Euro-American style knives and Asian style knives may find it necessary to purchase two types of knife sharpeners to properly sharpen both styles of knives. This could be inconvenient and financially prohibitive for some users.

Approaches have been proposed for addressing the challenges mentioned hereinabove. For example, U.S. Pat. No. 4,494,339 to Pittaway relates to knife sharpeners of a kind which are incorporated in a holder for the knife in which the knife is placed when not in use. The knife sharpener comprises the holder for the knife when the knife is not in use, sharpening means (i.e., an abrasive wheel) for sharpening the cutting edge of the knife as a result of the action of positioning the knife in the holder and/or the action of withdrawing the knife from the holder. Means are provided for selectively varying the pressure of engagement of the cutting edge with the sharpening means to vary the extent of sharpening occurring during withdrawal and/or replacement of the knife. Means are also provided for removing any particles which may adhere to the knife as a result of the sharpening action. More specifically, an optional feature is the provision of means for cleaning particles from the knife during insertion and/or withdrawal of the blade from the holder and may take the form of a pair of brushes, magnets provided in a removable frame, or magnetized particles in a plastic molding which constitutes the frame of the device.

Another approach is provided by U.S. Pat. No. 5,390,431 to Friel. This patent relates to an improved method and apparatus for sharpening knives and blades. According to this patent, a multi-stage process is used to sharpen knives and blades. More specifically, both facets of a double faceted blade are simultaneously sharpened as the facets are moved across a first pair of planar abrasive coated surfaces in a first stage. The abrasive coated surfaces cross to form a vertex. The abrasive coated surfaces are also positioned to establish a total included angle at the vertex nominally equal to the intended total included angle of the edge facet. A second stage sharpens closer to the edge of the blade and in general a finer grit abrasive will be used in the second stage to refine and perfect the edge geometry. This patent states that, where there would be excessive wear over extended periods of time, provisions in the sharpener's design can be made for the rapid replacement of the abrasive surfaces. This patent also states that where ferromagnetic knives are sharpened, the invention may be practiced by providing a magnet in the sharpening section to collect the metal filings.

Yet another approach is provided by U.S. Patent Application Publication US2009/0233530 to Friel, Sr, et al. This published patent application relates to a precise knife sharpener that is versatile in that it can sharpen virtually all of a large variety of knives made throughout the world, with widely different edge angles, to create edges of original factory quality. This patent application publication recognizes that knives from Asia are generally sharpened at very low edge angles with a primary edge facet centered at about 15°. This patent application publication also recognizes that knives of European, American or Western countries generally are sharpened at higher angles of about 20° for the primary facet. According to this patent, the apparatus of the invention is flexible enough to sharpen both 15° and 20° knives and yet create better than factory quality edges on both, The motor driven sharpener of the invention has two sharpening stages. These stages are Stage 1, Stage 2 and a single stropping Stage 3. Stage 1 is designed for and dedicated to the initial sharpening of Asian style knives that have 15 degree primary facets and which are inserted alternatively in a left and then in a right slot of the first stage. Euro-American style knives are sharpened in Stage 2 where knife guides are set at an angle of about 20°. At Stage 3, knife guides are set at a large angle to the vertical, compared to Stage 1. All knives, after their initial sharpening in Stage 1 or Stage 2, are finished by stropping in Stage 3.

Although the approaches recited hereinabove disclose various means for abrasively sharpening knives, the approaches recited hereinabove do not appear to disclose the invention described and claimed hereinbelow.

SUMMARY OF THE INVENTION

The present invention addresses the shortcomings of the prior art approaches mentioned hereinabove by providing an adjustable knife holder adapted to maintain sharpness of a knife blade and a method of manufacturing the adjustable knife holder. It is believed the adjustable knife holder of the present invention is a new and nonobvious device that keeps knives sharp at all times and removes the need to resharpen knives at periodic or regular intervals. The invention also cleans the knife by use of a magnet that removes sharpening debris, allows for convenient replacement of dulled sharpening surfaces and is capable of sharpening knives of various styles, such as Euro-American and Asian styles. Use of the invention also allows for maintaining sharpness of knives of various types and sizes of blade widths and blade lengths, such as paring knives, butcher knives and cleavers, multi-tool or utility knives, survival knives, surgical knives, and many other types and sizes of knives.

According to an aspect of the present invention, there is provided an adjustable knife holder adapted to maintain sharpness of a knife blade, comprising: a housing defining an interior volume therein a sharpener disposed in the interior volume defined by the housing for sharpening the knife blade to maintain sharpness of the knife blade, the sharpener defining a predetermined included angle; a moveable slider disposed in the interior volume and coupled to the sharpener for slidably moving the sharpener into adjustable engagement with the knife holder; and a plate member having a predetermined contour, the plate member being adapted to removably couple to the housing, the plate member defining an aperture sized to accommodate insertion of the knife blade therethrough.

According to another aspect of the present invention there is provided an elongate housing defining an interior volume therein; a sharpener disposed in the interior volume defined by the housing for sharpening the knife blade to maintain sharpness of the knife blade, the sharpener having a V-shaped configuration in transverse cross-section defining a predetermined included angle for matingly receiving and sharpening the knife blade; a moveable slider disposed in the interior volume and connected to the sharpener for slidably moving the sharpener into adjustable engagement with the knife blade; a plate member having a predetermined size and contour, the plate member being adapted to removably connect to the housing, the plate member defining an elongate slot sized to accommodate insertion of the knife blade therethrough; and a resilient biasing member connected to the moveable slider for biasing the moveable slider, whereby the moveable slider moves while the biasing member biases the moveable slider and whereby the sharpener adjustably engages the knife blade for applying a predetermined pressure to the knife blade while the moveable slider moves.

According to yet another aspect of the present invention, there is provided a method of manufacturing an adjustable knife holder adapted to maintain sharpness of a knife blade, comprising the steps of: providing a housing defining an interior volume therein; disposing a sharpener in the interior volume defined by the housing for sharpening the knife blade to maintain sharpness of the knife blade, the sharpener defining a predetermined included angle; disposing a moveable slider in the interior volume; coupling the moveable slider to the sharpener for slidably moving the sharpener into adjustable engagement with the knife holder; and removeably coupling a plate member to the housing, the plate member having a predetermined size and defining an aperture sized to accommodate insertion of the knife blade therethrough.

A feature of the present invention is the provision of a sharpener for sharpening a knife blade to maintain sharpness of the knife blade, the sharpener defining a predetermined included angle.

Another feature of the present invention is the provision of a moveable slider coupled to the sharpener for slidably moving the sharpener into adjustable engagement with the knife blade.

An additional feature of the present invention is the provision of a plate member removably coupled to a housing that encloses the knife blade, the plate member defining an aperture sized to accommodate insertion and withdrawal of the knife blade therethrough and having a predetermined contour allowing complete insertion of knife blades of various sizes.

Yet another feature of the present invention is the provision of a magnet that automatically cleans the knife blade by magnetically removing sharpening debris as the knife blade is removed from the housing.

In addition to the foregoing, various other method and/or device aspects and features are set forth and described in the teachings, such as text (e.g., claims and/or detailed description) and/or drawings of the present invention.

The foregoing is a summary and thus may contain simplifications, generalizations, inclusions, and/or omissions of detail. Consequently, those skilled in the art will appreciate that the summary is illustrative only and is not intended to be in any way limiting. In addition to the illustrative aspects, embodiments, and features described hereinabove, further aspects, embodiments, and features will become apparent by reference to the drawings and the following detailed description.

BRIEF DESCRIPTION OF THE DRAWINGS

The invention will be more fully understood by reference to the detailed description in conjunction with the following figures, wherein.

DETAILED DESCRIPTION OF PREFERRED EMBODIMENTS

Figure 1:
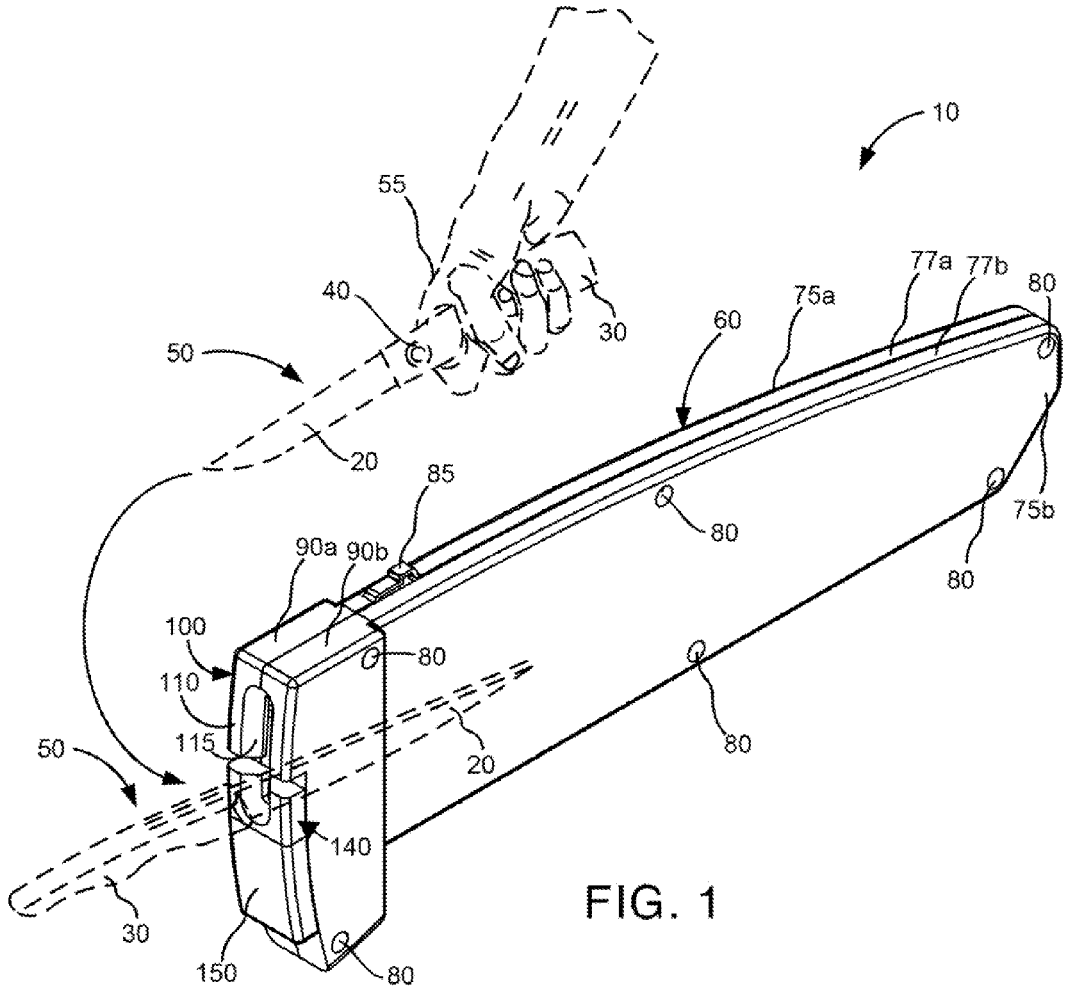
FIG. 1 is a view in perspective of an adjustable knife holder according to the present invention and in operative condition to maintain sharpness of a knife blade.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from either the spirit or scope of the invention.

In addition, the present patent specification uses formal outline headings for clarity of presentation. However, it is to be understood that the outline headings are for presentation purposes, and that different types of subject matter may be discussed throughout the application (e.g., device(s)/structure(s) may be described under process(es)/operations heading(s) and/or process(es)/operations may be discussed under structure(s)/process(es) headings; and/or descriptions of single topics may span two or more topic headings). Hence, the use of the formal outline headings is not intended to be in any way limiting.

Therefore, with reference to FIG. 1, there is shown an adjustable knife holder, generally referred to as 10, adapted to maintain sharpness of a knife blade 20. The knife blade 20 is attached to a knife handle 30 by fastener means 40, such as a screw or bolt. Knife blade 20 and knife handle 30 form a knife, generally referred to as 50, that is manipulated by a hand 55 of a user. Knife 50, which forms no part of the present invention, may be virtually any type, style or size of knife. For example, knives usable with the invention include, by way of example only, paring knives used in home kitchens, butcher knives and cleavers used in butcher shops, multi-tool or utility knives used as box cutters in warehouses, survival knives used by outdoorsmen and having a hollow handle for storing equipment, surgical knives used in surgical procedures, and many other types and sizes of knives for a multiplicity of uses. With respect to ceramic knives, although not magnetically cleaned, the user can nonetheless sharpen a ceramic knife using the invention or the user may return the ceramic knife to the manufacturer for sharpening.

Referring again to FIG. 1, and as previously mentioned, knife 50 may have been selected from two popular styles. For example, knife 50 may be a Euro-American style knife having a manufactured included V-shaped blade angle of 20° in transverse cross-section. Alternatively, knife 50 may be an Asian style knife having a manufactured included V-shaped blade angle of 15° in transverse cross-section. The manner in which these two popular knife styles are used with the invention is described in more detail hereinbelow.

Referring again to FIG. 1, adjustable knife holder 10 comprises an elongate housing, generally referred to as 60, defining an interior volume 70 therein (see FIG. 5) As shown in FIG. 1, housing 60 is elongated for accommodating knife blades 20 of longer length. Also, elongate housing 60 is bifurcated lengthwise so as to define two halves, such as a first half 75*a* and a second half 75*b*, interconnectable by a plurality of fasteners 80. If desired, rather than fasteners 80, first half 75*a* and second half 75*b* may be interconnectable or joined by a snap fit at the locations where fasteners 80 would otherwise be located. Each of first half 75*a* and second half 75*b* defines a first top surface 77*a* and a second top surface 77*b* thereon, respectively. Integrally attached to either of first top surface 77*a* or second top surface 77*b* is a locking mechanism 85 for locking first half 75*a* and second half 75*b* together. As described in detail hereinbelow, bifurcation of housing 60 allows access to interior volume 70 for installation of internal components during manufacture or for convenient replacement of internal components subsequent to manufacture. As described in detail hereinbelow, other means are also provided for convenient replacement of some of the components associated with adjustable knife holder 10.

Figure 2:
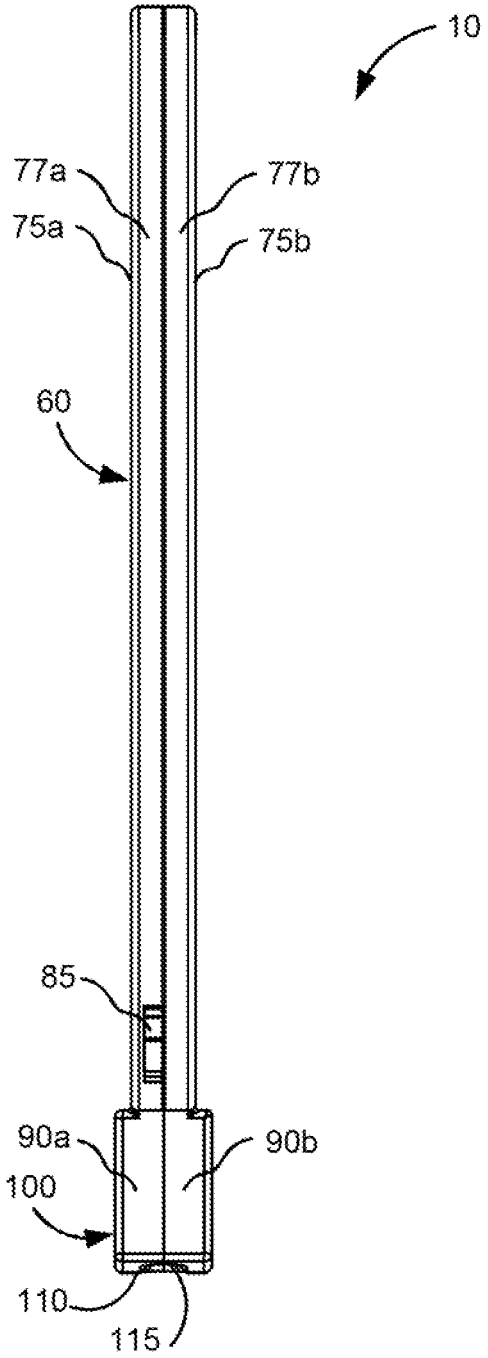
FIG. 2 is a top plan view of the adjustable knife holder.
Figure 3:
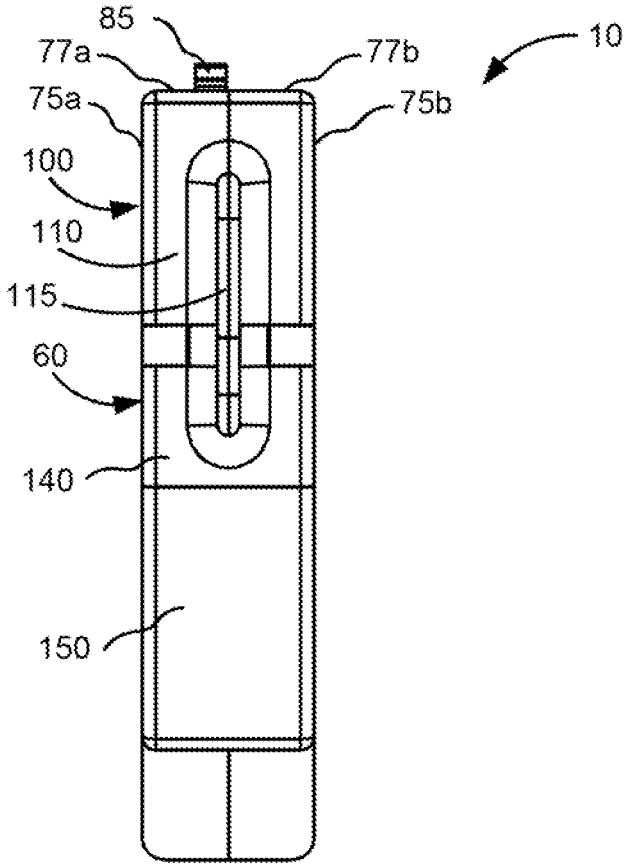
FIG. 3 is a front view in elevation of the adjustable knife holder.

Referring to FIGS. 1, 2 and 3, each of first half 75*a* and second half 75*b* of adjustable knife holder 10 includes a vertically oriented first anterior portion 90*a* and a vertically oriented second anterior portion 90*b*, respectively. When first half 75*a* and second half 75*b* are joined together, first anterior portion 90*a* and second anterior portion 90*b* are also joined together, so as to form an enclosure, generally referred to as 100, at a front end portion of adjustable knife holder 10. Interior volume 70 includes an interior space 105 defined by first anterior portion 90*a* and second anterior portion 90*b* when first anterior portion 90*a* and second anterior portion 90*b* are joined together. A purpose of interior space 105 is to enclose knife sharpening components, as described in detail hereinbelow. Enclosure 100 defines a front surface 110 thereon of convex contour for reasons provided hereinbelow. Front surface 110 also defines an aperture 115 beveled and sized to accommodate insertion of knife blade 20 therethrough. As previously mentioned, knife blade 20 can have virtually any width, such as widths associated with paring knives, butcher knives and cleavers, multi-tool or utility knives, survival knives, surgical knives and other types of knives. Housing 10 can be formed from any suitable material such as, by way of example only and not by way of limitation, metal, metal alloy, wood, fabric stiffened for rigidity, or polymerized material (i.e., plastic). In addition, a first base portion 117*a* belonging to first anterior portion 90*a* and a second base portion belonging to second anterior portion 90*b* comprises a magnetic material or magnet 118 (see FIG. 6B). The magnet 118 attracts metal debris (not shown) being sheared from knife blade 20. Magnet 118 causes the metal debris to separate from knife 50 and then fall between finger-like projections 210 (see FIG. 6C) and into an open recess or channel 119 formed in sharpening stone support 180. Channel 119 is located beneath vertex 190 (see FIG. 6B) that is defined by first stone 200*a* and second stone 20010. The debris collects in channel 119 and is subsequently emptied by the user. Thus, the debris is attracted into channel 119 by magnetic force exerted on the debris due to the presence of magnet 118. Also, the presence of magnet 118 speeds entry of the debris into channel 119, due to the magnetic force exerted thereby, and therefore speeds the knife cleaning process. On the other hand, in the event knife 50 is a ceramic knife; then, the debris will eventually fall into channel 119 due to force of gravity.

Figure 4:
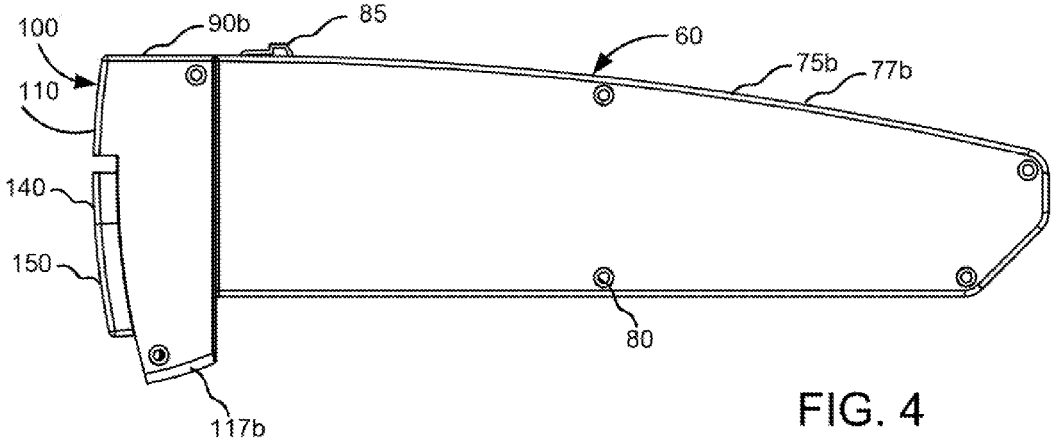
FIG. 4 is a view in elevation of a right side of the adjustable knife holder.
Figure 5:
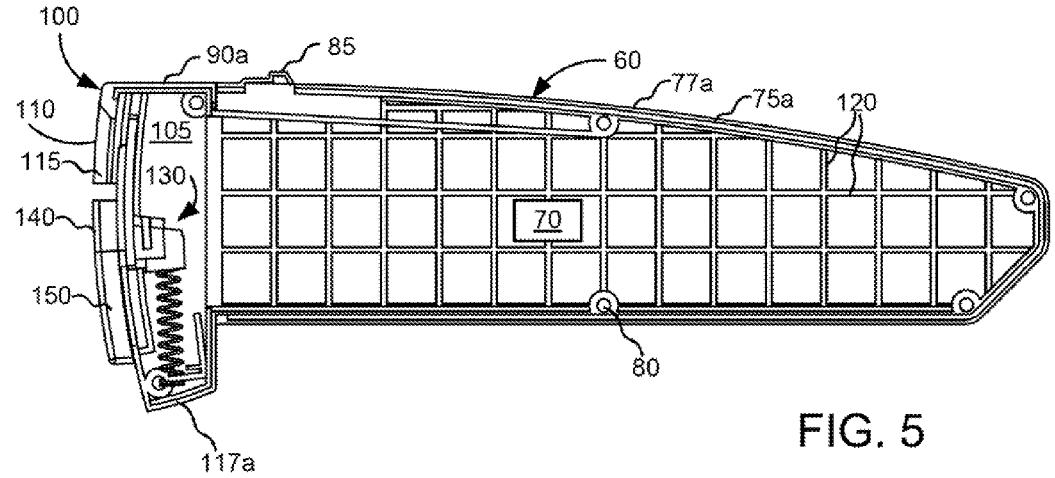
FIG. 5 is a view in elevation of left side of the adjustable knife holder, this view also showing an interior of the adjustable knife holder.

Referring to FIGS. 4 and 5, housing 60 comprises a plurality of reinforcing stiffeners 120 integrally formed therewith and disposed in interior volume 70 for strengthening housing 60. Strengthening housing 60 in this manner reduces risk that adjustable knife holder 10 is significantly damaged due to inadvertent impact with nearby objects (not shown). Reinforcing stiffeners 120 may be arranged in an interconnected crucifix pattern, as shown, or in any other suitable pattern, such as an "X" pattern (not shown).

Referring to FIGS. 4, 5, 6, 6A, 6B and 6C, disposed in interior space 105 that is defined by enclosure 100 is an adjustable sharpener assembly, generally referred to as 130, for maintaining sharpness of blade 20. In this regard, sharpener assembly 130 comprises a faceplate, plate member or sharpener slider top 140 removably mountable on a sharpener slider bottom 150 in a manner described presently. In this regard, sharpener slider top 140 comprises a U-shaped block portion 160 defining a beveled opening 165 transversely therethrough for reasons described hereinbelow. Block portion 160 includes a rear side 162 and a bottom side 163. Upwardly projecting from block portion 160 and integrally attached thereto are a pair of elongate, spaced-apart first rails 170*a* and 170*b* disposed adjacent to each other. Spaced-apart rails 170*a* and 170*b* define a first gap 175 therebetween. First gap 175 is aligned with opening 165 for accepting knife blade 20 through opening 165 and then through first gap 175 for reasons stated hereinbelow. Integrally attached to the rear side 162 of block portion 160 is a sharpening stone support 180 defining a generally V-shaped notch 190 therein for receiving at least two abrasive stones, such as first abrasive stone 200*a* and second abrasive stone 200*b*, which are used to sharpen knife blade 20. Each of first stone 200*a* and second stone 200*b* includes a plurality of spaced apart, finger-like projections 210 adapted to interconnect first stone 200*a* and second stone 200*b* when first stone 200*a* and second stone 200*b* are removably disposed in notch 190. Interconnection of finger-like projections 210 retards substantial movement of first stone 200*a* and second stone 200*b* relative to each other. Retarding substantial movement of first stone 200*a* and second stone 200*b* relative to each decreases the probability that either of first stone 200*a* or second stone 200*b* will gradually slide along its oppositely disposed stone and out of notch 190. If one of the stones were to slide out of notch 190, then only one facet of a knife edge would thereafter be sharpened. Sharpening only one facet of the knife edge is usually undesirable. When disposed in notch 190, first stone 200*a* and second stone 200*b* will form a V-shaped configuration defining a predetermined included angle theta "θ" for matingly receiving and sharpening knife blade 20 at a vertex 215 that is defined by included angle "θ". The included angle theta "θ" is selected such that the included angle "θ" is substantially equal to the included angle of the knife blade's cutting edge when the knife blade's cutting edge resides at the vertex. For example, when sharpening Euro-American style knives the included angle theta "θ" is about twenty degrees. When sharpening Asian style knives, the included angle theta "θ" is about twelve degrees to about fifteen degrees. Sharpening debris will beneficially fall onto previously mentioned magnetized base 117*a*/117*b* for subsequent collection and emptying therefrom by the user. Moreover, each of first stone 200*a* and second stone 200*b* comprises an abrasive material selected from the group consisting essentially of natural whetstone, corundum, diamond, metal, metal alloy, ceramic, leather, sandpaper and combinations thereof.

Referring again to FIGS. 4, 5, 6, 6A, 6B and 6C, sharpener slider bottom 150 comprises a cube-shaped base portion 220 that includes a bottom side 225. Upwardly projecting from base portion 220 and integrally attached thereto are a pair of elongate, spaced-apart second rails 230*a* and 230*b* disposed adjacent to each other. Spaced-apart rails 230*a* and 230*b* define a second gap 235 therebetween. Width of sharpener slider top 140 is sized, such that the entire width of sharpener slider top 140 is able to fit into second gap 235 that is defined by second rails 230*a* and 230*b* of sharpener slider bottom 150. This configuration of sharpener slider top 140 and sharpener slider bottom 150 allows for convenient removal and replacement of block portion 160, which is considered a faceplate, as previously indicated. This configuration of sharpener slider top 140 and sharpener slider bottom 150 also allows sharpener slider top 140 to be guided by second rails 230*a* and 230*b* as sharpener slider top 140 is upwardly biased into engagement with knife blade 20, as described hereinbelow.

Figure 6:
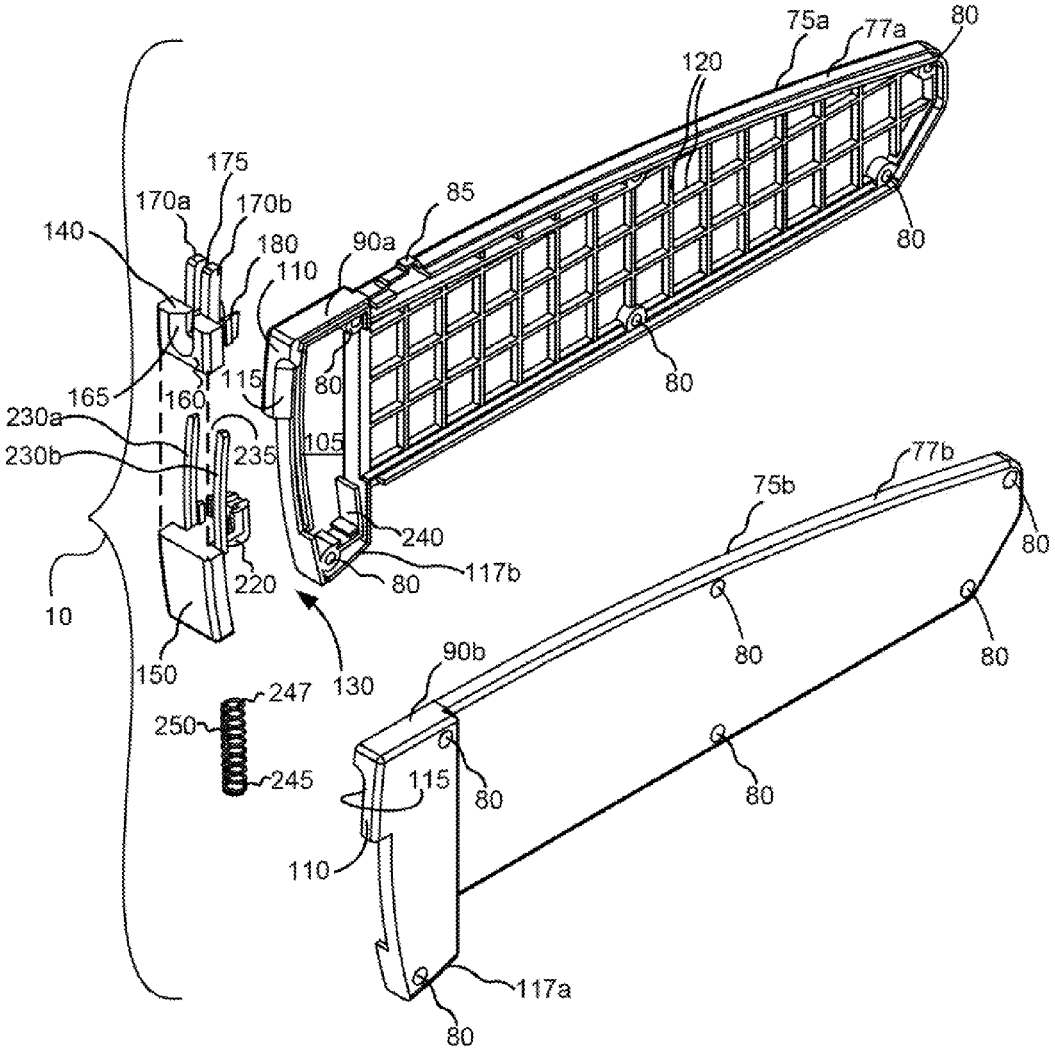
FIG. 6 is an exploded view in perspective of the adjustable knife holder.
Figure 6A:
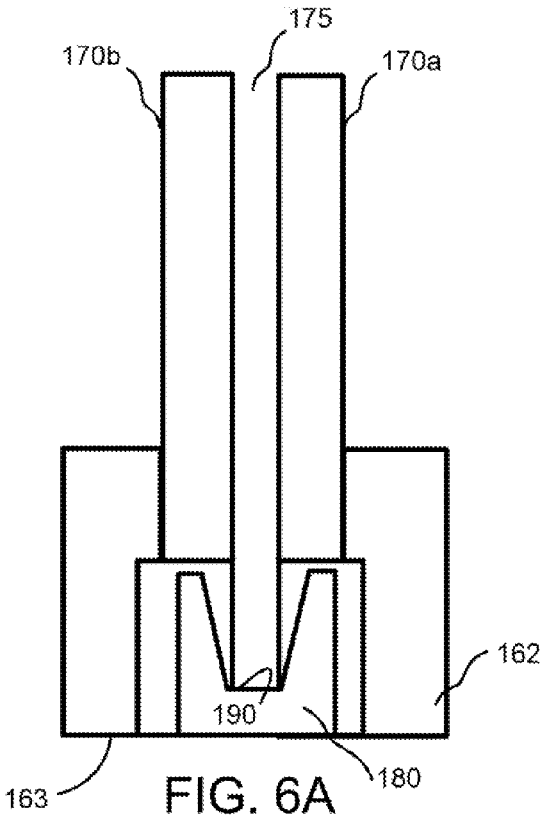
FIG. 6A is a rear view in elevation of a sharpener slider top defining a V-shaped notch on a rear side thereof.
Figure 6B:
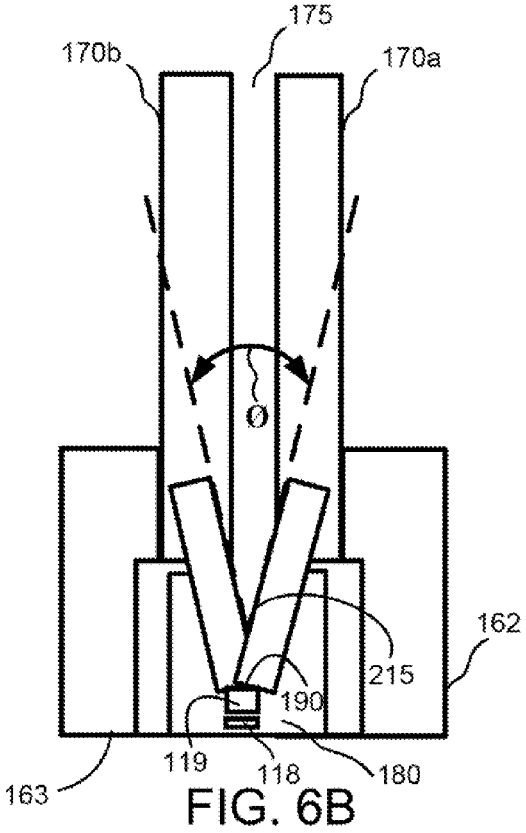
FIG. 6B is a rear view in elevation of the sharpener slider top having sharpening stones disposed in the V-shaped notch.
Figure 6C:
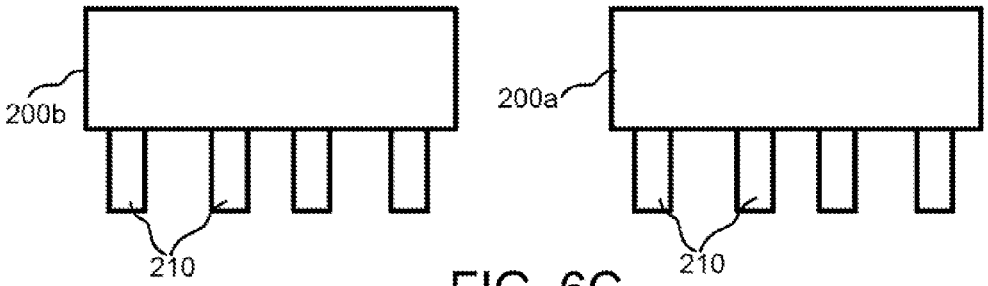
FIG. 6C is a view in elevation of two sharpening stones configured to be releasably interlocked.
Figure 7:
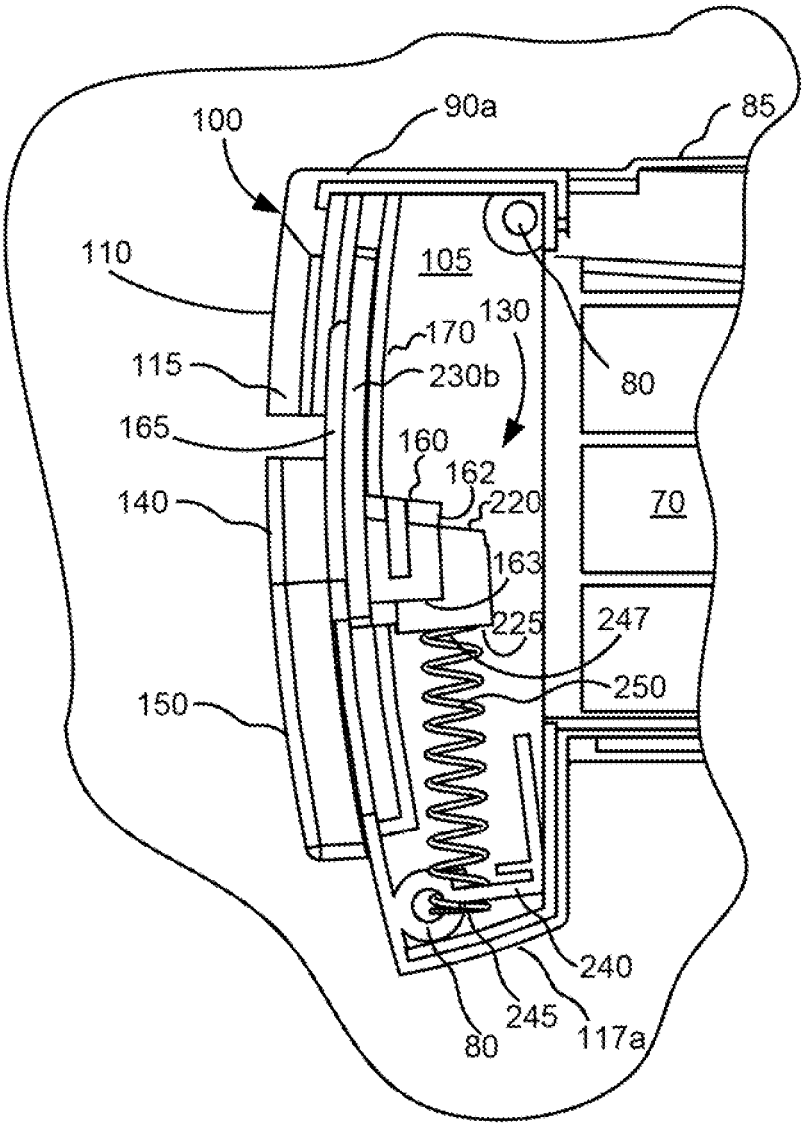
FIG. 7 is a fragmentary view in elevation of a sharpener assembly disposed in an interior space defined by a housing belonging to the knife holder.

As best seen in FIGS. 6 and 7, sharpener assembly 130 includes two components, which are previously mentioned sharpener slider top 140 and previously mentioned sharpener slider bottom 150. Sharpener slider bottom 150 functions as a base upon which sharpener top 140 can be mounted. In view of the teachings herein, it should be appreciated that sharpener slider top 140 and sharpener slider bottom 150 cooperate to always maintain sharpness of knife blade 20 rather than the current practice of resharpening knife blade 20 only at periodic intervals.

Still referring to FIGS. 4, 5, 6, 6A, 6B. 6C and 7, a stationary cradle 240 is disposed at a bottom portion of space 105 for reasons disclosed presently. In this regard, cradle 240, which may have a reversed L-shape configuration, is attached to housing 60 as at one of fasteners 80, as shown. Cradle 240 is adapted to receive a first end portion 245 of a biasing member, such as a resilient spring member 250. First end portion 245 of spring member 250 is affixed to cradle 240 and a second end portion 247 intimately engages sharpener slider bottom 150. Thus, spring 250 is interposed between cradle 240 and sharpener slider bottom 150, so as to upwardly bias sharpener slider bottom 150. As sharpener slider bottom 150 is upwardly biased, sharpener slider top 140 is also upwardly biased because sharpener slider top 140 is mounted on sharpener slider bottom 150. As sharpener slider top 140 is upwardly biased, the vertex 190 defined by first abrasive stone 200*a* and second abrasive stone 200*b* will receive the cutting edge of knife blade 20. As the cutting edge of knife blade 20 is received in vertex 190, first abrasive stone 200*a* and second abrasive stone 200*b* will apply pressure to the two facets of knife blade 20, so that sharpener assembly 130 automatically maintains sharpness of knife blade 20. More specifically, the cutting edge of knife blade 20 is sharpened when knife blade 20 is inserted into knife holder 10, and thus into sharpener assembly 130, for storage. Also, the cutting edge of knife blade 20 is again sharpened when knife blade 20 is withdrawn from knife holder 10, and thus from sharpener assembly 130, for use. In this manner, there is no need to periodically resharpen knife blade 20 because knife blade 20 is always maintained in a sharpened condition.

Referring again to FIGS. 4, 5, 6, 6A, 6B, 6C and 7, spring 250 inherently possesses a spring constant. A spring with a high spring constant is more resistant to being extended or shrunk than a spring with a low spring constant. When stretched the same distance, a spring with a higher spring constant applies a larger force than a spring with a lower spring constant. Spring 250 is selected such that the spring constant of spring 250 is relatively low in order that a relatively low force and low pressure is applied to the blade edge of knife blade 20 each time knife blade 20 slides along vertex 190 that is formed by first abrasive stone 200*a* and second abrasive stone 200*b*. Knife blade 20 will slide along vertex 190 only when knife 50, having knife blade 20, is inserted into adjustable knife holder 10 for storage and when knife 50 is withdrawn from knife holder 10 for use. This low force and low pressure will remove a relatively small amount of metal from the knife edge compared to commonly practiced resharpening techniques that remove substantially more metal from the knife blade. In this manner, knife blade 20 is automatically sharpened before and after each use, rather than being sharpened only periodically. Thus, adjustable knife sharpener 10 maintains the sharpness of knife blade 20 rather than resharpening knife blade 20.

Figure 8:
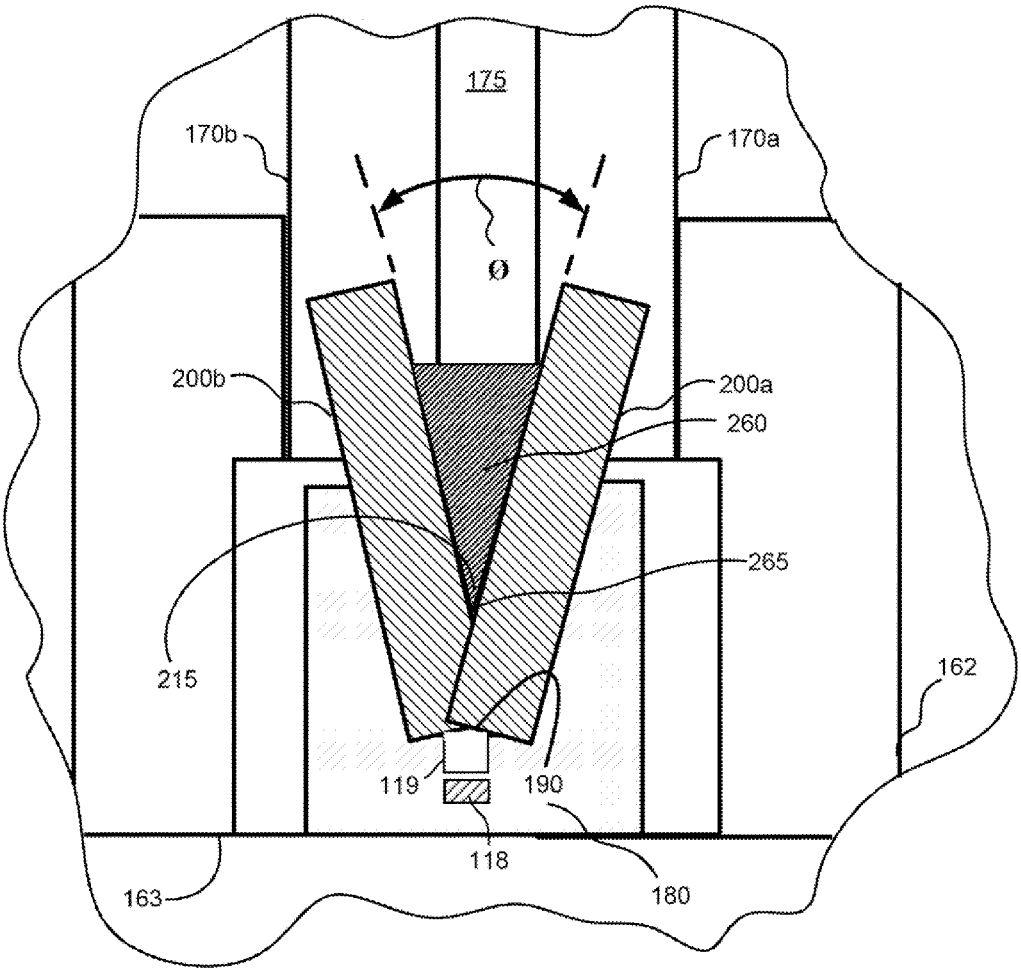
FIG. 8 is a fragmentary view in vertical section of a knife edge having an acute included angle of 20° and engaging the vertex of the two sharpening stones belonging to the invention.
Figure 9:
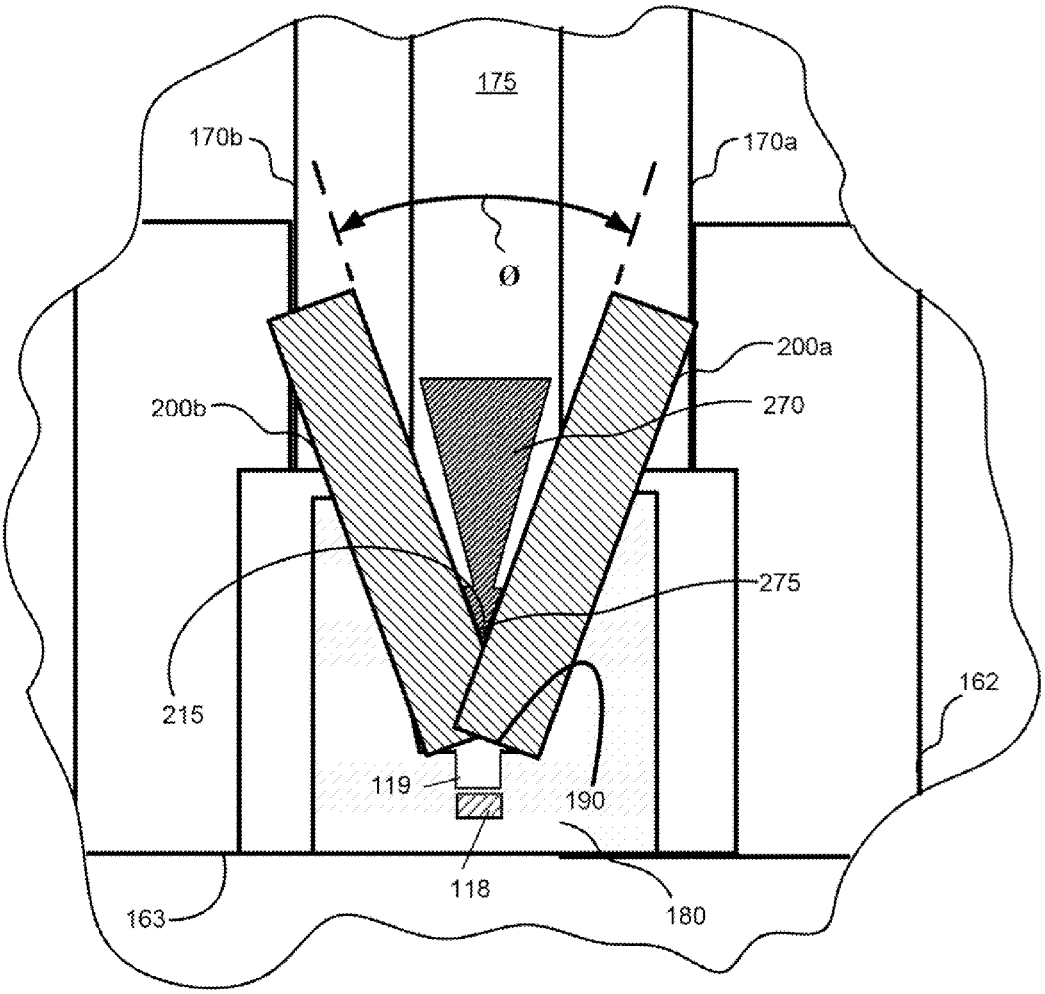
FIG. 9 is a fragmentary view in vertical section of a beveled knife edge having an included angle of 12° and engaging the vertex of two sharpening stones belonging to the invention.

With reference to FIGS. 8 and 9, the knife blade can be a Euro-American style knife blade 260 having an acute cutting edge 265 defining the included angle "θ" of about twenty degrees. Alternatively, the knife blade may be an Asian style knife blade 270 having an arrow-shaped beveled cutting edge 275 defining an included angle "θ" of between twelve degrees and fifteen degrees. Thus, adjustable knife holder 10 is adapted to maintain sharpness of both Euro-American style knife blades and Asian style knife blades, as well as other styles of knife blades depending on the value selected for the angle "θ". In addition, the previously mentioned convex contour of front surface 110 allows either of knife blades 260/270 to be completely inserted through 115 and thoroughly engage sharpener assembly 130.

Figure 10:
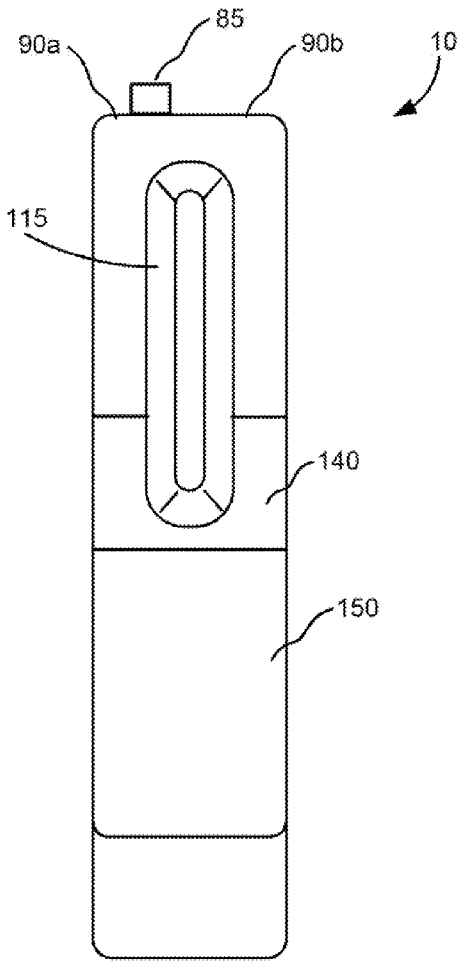
FIG. 10 is a view in elevation of an exemplary adjustable knife holder defining a slot therein of shorter length for accommodating knives of smaller size.
Figure 11:
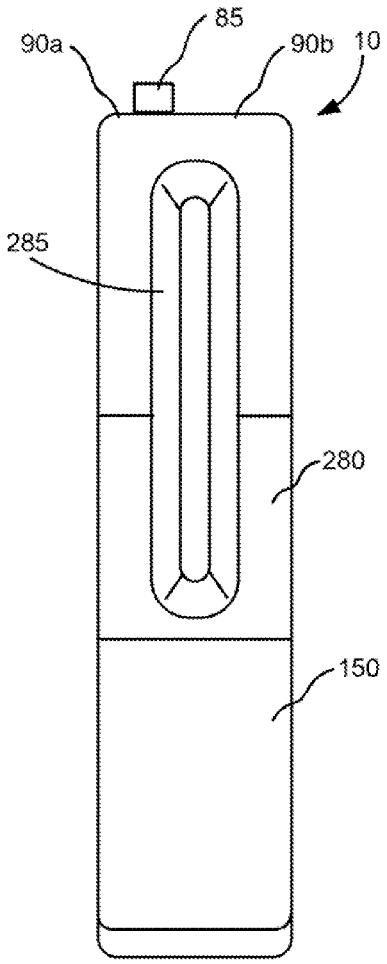
FIG. 11 is a view in elevation of another exemplary adjustable knife holder defining a slot therein of longer length for accommodating knives of larger size.
Figure 12:
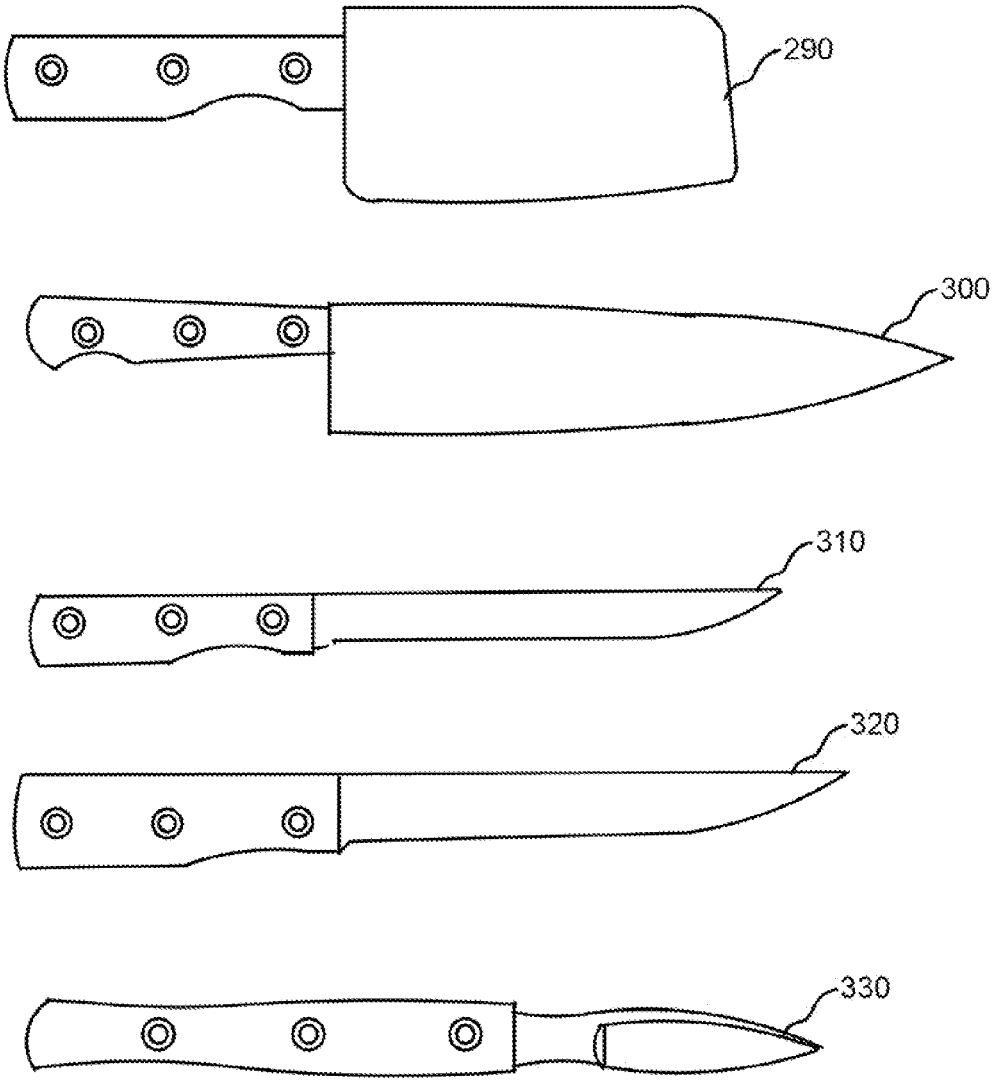
FIG. 12 illustrates exemplary types and sizes of knives useable with the present invention.

Referring to FIGS. 10, 11 and 12, and as previously indicated, adjustable knife holder 10 can accommodate knives 20 of different sizes, as well as knives 20 of different styles. With regard to knives 20 having different sizes, sharpener slider top 140 defining a shorter length slot 115 may be replaced by or interchanged with another sharpener slider top 280 defining a longer length slot 285, if desired, for sharpening knives of larger size. Conversely, the other sharpener slider top 280 may be replaced by or interchanged with sharpener slider top 140, if desired. In this manner, adjustable knife holder 10 is adjustable for maintaining sharpness of different size knives, such as a butcher's knife or meat cleaver 290, a chefs knife 300, a paring knife 310, a steak knife 320, a surgical knife 330 or other type and size of knife.

Moreover, it should be appreciated that adjustable knife holder 10 is adjustable in several respects. In this regard, adjustable knife holder 10 is adjustable in the sense that it adjusts to knives of various types, styles and sizes due to the interchangeability of sharpener slider top 140. In addition, adjustable knife holder 10 is adjustable in the sense that it adjusts to knives of various sizes due to the cooperative action of spring member 250 and sharpener slider top 140 because spring member 250 biases sharpener slider top 140 into intimate engagement with the particular size of knife being sharpened.

Illustrative Methods:

An illustrative method associated with an exemplary embodiment for manufacturing an adjustable knife holder adapted to maintain sharpness of a knife blade will now be described.

Figure 13:
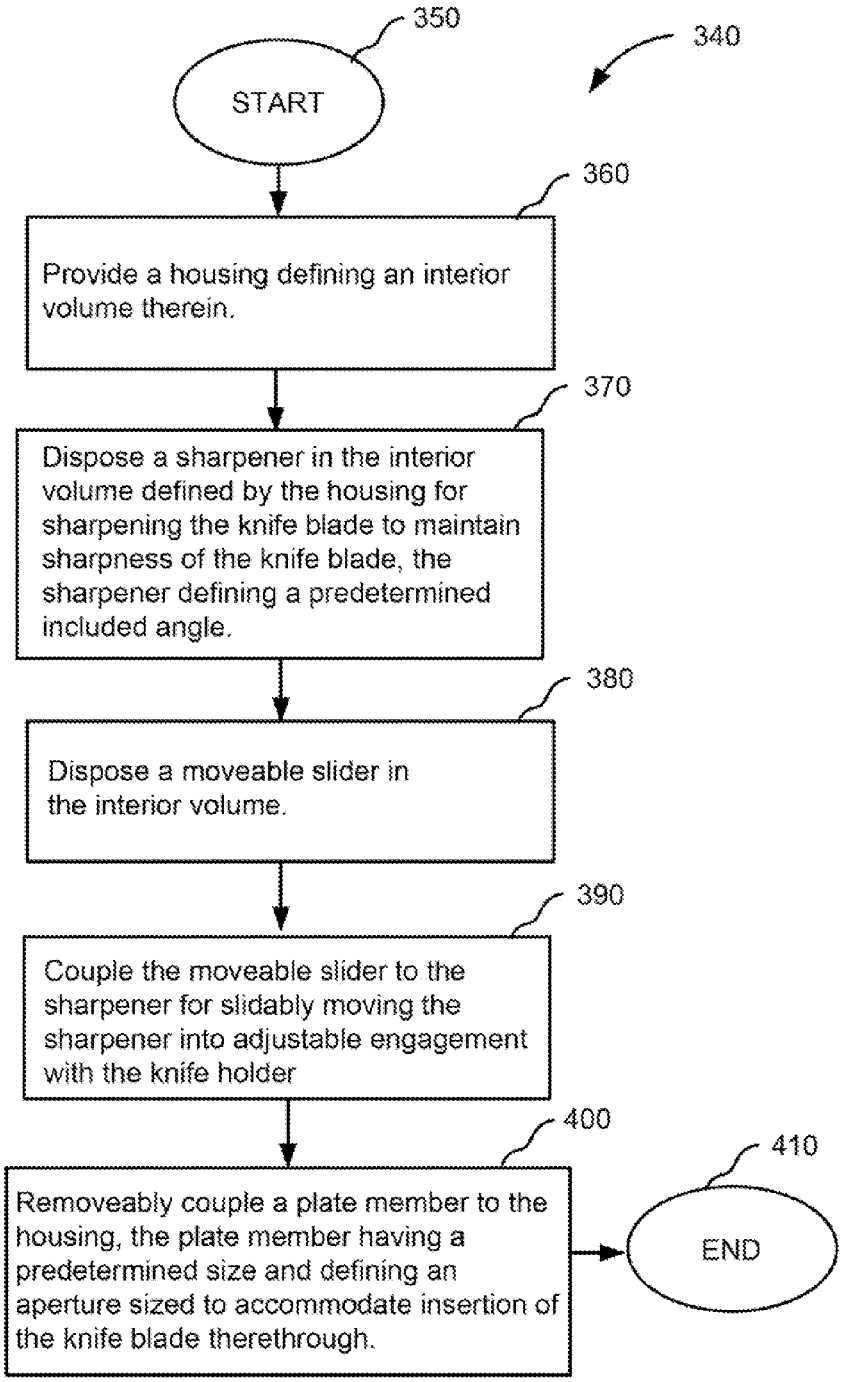
FIG. 13 is a flowchart showing an illustrative method of manufacturing the adjustable knife holder.

Referring to FIG. 13, an illustrative method, generally referred to as 340 is provided for maintaining sharpness of a knife blade. The method starts at a step 350. At a step 360, a housing defining an interior volume therein is provided. At a step 370, a sharpener is disposed in the interior volume defined by the housing for sharpening the knife blade to maintain sharpness of the knife blade, the sharpener defining a predetermined included angle. At a step 380, a moveable slider is disposed in the interior volume. At a step 390, the moveable slider is coupled to the sharpener for slidably moving the sharpener into adjustable engagement with the knife holder. At a step 400, a plate member is removably coupled to the housing, the plate member having a predetermined size and defining an aperture sized to accommodate insertion of the knife blade therethrough. The method stops at a step 410.

Other modifications and implementations will occur to those skilled in the art without departing from the spirit and the scope of the invention as claimed. For example, there may be a plurality of adjacent, adjustable knife holders integrally connected one to the other and arranged laterally or vertically. Each of the adjacent, adjustable knife holders would be specially configured to accept and maintain the sharpness of a particular knife style and knife size. In this manner, the plurality of adjacent and adjustable knife holders would provide a user thereof with maximum flexibility and efficiency in sharpening a wider variety of differing styles and sizes of knives.

The claims will be interpreted according to law. However, and notwithstanding the alleged or perceived ease or difficulty of interpreting any claim or portion thereof, under no circumstances may any adjustment or amendment of a claim or any portion thereof during prosecution of the application or applications leading to this patent be interpreted as having forfeited any right to any and all equivalents thereof that do not form a part of the prior art.

All of the features disclosed in this specification may be combined in any combination. Thus, unless expressly stated otherwise, each feature disclosed is only an example of a generic series of equivalent or similar features.

It is to be understood that while the invention has been described in conjunction with the detailed description thereof, the foregoing description is intended to illustrate and not limit the scope of the invention, which is defined by the scope of the appended claims. Thus, from the foregoing, it will be appreciated that, although specific embodiments of the invention have been described herein for the purpose of illustration, various modifications may be made without deviating from the spirit and scope of the invention. Other aspects, advantages, and modifications are within the scope of the following claims and the present invention is not limited except as by the appended claims.

The specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. The invention illustratively described herein suitably may be practiced in the absence of any element or elements, or limitation or limitations, which is not specifically disclosed herein as essential. Thus, for example, in each instance herein, in embodiments or examples of the present invention, the terms "comprising", "including", "containing", etc. are to be read expansively and without limitation. The methods and processes illustratively described herein suitably may be practiced in differing orders of steps, and that they are not necessarily restricted to the orders of steps indicated herein or in the claims.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by various embodiments and/or preferred embodiments and optional features, any and all modifications and variations of the concepts herein disclosed that may be resorted to by those skilled in the art are considered to be within the scope of this invention as defined by the appended claims.

The invention has been described broadly and generically herein. Each of the narrower species and subgeneric groupings falling within the generic disclosure also form part of the invention. This includes the generic description of the invention with a proviso or negative limitation removing any subject matter from the genus, regardless of whether or not the excised material is specifically recited herein.

It is also to be understood that as used herein and in the appended claims, the singular forms "a," "an," and "the" include plural reference unless the context clearly dictates otherwise, the term "X and/or Y" means "X" or "Y" or both "X" and "Y", and the letter "s" following a noun designates both the plural and singular forms of that noun. In addition, where features or aspects of the invention are described in terms of Markush groups, it is intended and those skilled in the art will recognize, that the invention embraces and is also thereby described in terms of any individual member or subgroup of members of the Markush group.

Other embodiments are within the following claims. The issued patent may not be interpreted to be limited to the specific examples or embodiments or methods specifically and/or expressly disclosed herein. Under no circumstances may the issued patent be interpreted to be limited by any statement made by any Examiner or any other official or employee of the Patent and Trademark Office unless such statement is specifically and without qualification or reservation expressly adopted in a responsive writing by Applicant(s).

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

Therefore, provided herein are an adjustable knife holder adapted to maintain sharpness of a knife blade and a method of manufacturing the adjustable knife holder.

What is claimed is:

1. An adjustable knife holder, comprising:

a bifurcated housing defining a horizontally oriented bifurcated posterior enclosure having an interior volume for receiving therein a knife blade for storage purposes until needed for use and a vertically oriented bifurcated anterior enclosure having an interior space for retaining in place an adjustable sharpener assembly for sharpening the knife blade as the knife blade is inserted into and extracted from the adjustable knife holder, wherein the adjustable sharpener assembly includes a sharpener slider top, a sharpener slider bottom located below the sharpener slider top, a reversed L-shaped stationary cradle located adjacent to the sharpener slider bottom, and a biasing member located between the sharpener slider bottom and the reversed L-shaped cradle in order to upwardly bias the sharpener slider bottom; and wherein the adjustable sharpener assembly includes a pair of abrasive stones oriented in a V-shaped configuration for defining a predetermined angle Ø for matingly receiving and sharpening the knife blade at a vertex of the angle Ø as the knife blade is slidingly passed through the vertically oriented bifurcated anterior enclosure and into the horizontally oriented bifurcated posterior enclosure for storage and for matingly receiving and sharpening the knife blade at the vertex of the angle Ø as the knife blade is slidingly extracted from the horizontally oriented bifurcated posterior enclosure and continuing sliding extraction from the vertically oriented bifurcated anterior enclosure until removed from the adjustable knife holder for use.

2. The adjustable knife holder, as in claim 1, wherein the bifurcated housing further includes an integrally attached locking mechanism located along an upper portion of the horizontally oriented bifurcated posterior enclosure and adjacent to the vertically oriented bifurcated anterior enclosure for locking the horizontally oriented bifurcated posterior enclosure and the vertically oriented bifurcated anterior enclosure together in an assembled state and for unlocking the horizontally oriented bifurcated posterior enclosure and the vertically oriented bifurcated anterior enclosure from one another to facilitate their separation for knife holder adjustment purposes.

3. The adjustable knife holder, as in claim 1, wherein the interior space includes a first base portion and a second base portion, the first base portion and the second base portion, when joined together, define a magnetic base member disposed at a bottom of the interior space to facilitate an attraction of metal debris being sheared from the knife blade as the knife blade is inserted into the knife holder or as the knife blade is extracted from the knife holder.

4. The adjustable knife holder, as in claim 1, wherein the vertically oriented bifurcated anterior enclosure defines a convex contoured front surface that is provided with a beveled aperture sized to accommodate insertion of the knife blade there through.

5. The adjustable knife holder, as in claim 1, wherein the sharpener slider top includes a U-shaped block portion having a rear side, a bottom side, a beveled opening extending transversely through the U-shaped block portion and a pair of elongate, spaced-apart first rail members extending upwardly from the U-shaped block portion, wherein a front side of the pair of elongate, spaced-apart first rail members is located adjacent to the rear side of the U-shaped block portion, wherein the pair of elongate, spaced-apart first rail members define a first gap there between, wherein the first gap is disposed in alignment with the beveled opening for accepting the knife blade through the opening and then through the first gap to facilitate knife blade sharpening purposes.

6. The adjustable knife holder, as in claim 5, wherein the knife holder is further comprised of:

a sharpening stone support integrally attached to the rear side of the U-shaped block portion, the sharpening stone support defining a generally V-shaped notch for removably receiving the pair of abrasive stones, wherein the pair of abrasive stones cooperate with one another to shear metal debris from the knife blade as the knife blade passes through the opening and then through the first gap.

7. The adjustable knife holder, as in claim 6, wherein a first abrasive stone of the pair of abrasive stones includes a plurality of spaced-apart, finger-like projections, wherein a second abrasive stone of the pair of abrasive stones includes another plurality of spaced-apart, finger-like projections, the plurality of spaced-apart, finger-like projections and the another plurality of spaced-apart, finger-like projections cooperate to facilitate interconnection of the first abrasive stone and the second abrasive stone when the first abrasive stone and the second abrasive stone are disposed within the V-shaped notch to substantially retard movement of the first abrasive stone relative to the second abrasive stone as the knife blade passes against the first abrasive stone and against the second abrasive stone as the knife blade is being inserted into the knife holder or removed from the knife holder.

8. The adjustable knife holder, as in claim 5, wherein the sharpener slider bottom includes a cube-shaped base portion located on a rear side of the sharpener slider bottom, wherein the cube-shaped base portion includes a bottom side and a pair of upwardly projecting integrally attached elongate, spaced-apart, second rails and disposed adjacent to one another, wherein the pair of upwardly projecting integrally attached elongate, spaced-apart, second rails define a second gap there between.

9. The adjustable knife holder, as in claim 8, wherein the sharpener slider top has a width dimension of no greater than the second gap to enable the entire width of the sharpener slider top to fit into the second gap defined by the pair of upwardly protecting integrally attached elongate, spaced-apart, second rails to facilitate the removal and replacement of the U-shaped block portion for accommodating the storage and sharpening of different types and kinds of knife blades within the knife holder.

10. The adjustable knife holder, as in claim 1, wherein the sharpener slider top is supported from below by the sharpener slider bottom and wherein the reversed L-shaped cradle is attached to the bifurcated housing at about a bottom portion of the interior space to help facilitate the upward biasing of the sharpener slider bottom by the biasing member.

11. The adjustable knife holder, as in claim 1, wherein the biasing member is interposed between the reversed L-shaped cradle and the sharpener slider bottom to upwardly bias the sharpener slider bottom which, in turn, urges the sharpener slider top upwardly to facilitate receiving a cutting edge of the knife blade within the vertex while applying sufficient pressure by the pair of abrasive stones to knife blade facets as the knife blade is inserted into the knife blade holder or when the knife blade is withdrawn from the knife blade holder.

12. The adjustable knife holder, as in claim 1, wherein the biasing member is a spring, the spring being selected from a group of springs consisting of low spring constants so that a sharpening pressure is applied to cutting edge facets of the knife blade to facilitate removal of an amount of metal from the cutting edge facets as the knife blade is inserted into the knife holder for storage purposes and to further facilitate removal of an amount of metal from the cutting edge facets of the knife blade as the knife blade is removed from the knife holder for subsequent use.

13. A method of manufacturing an adjustable knife holder adapted to maintain sharpness of a knife blade, comprising the steps of:

providing a bifurcated housing defining a horizontally oriented bifurcated posterior enclosure having an interior volume for receiving therein a knife blade for storage purposes until needed for use and a vertically oriented bifurcated anterior enclosure having an interior space for positioning and retaining an adjustable sharpener assembly for sharpening the knife blade as the knife blade is inserted into and extracted from the adjustable knife holder, wherein the adjustable sharpener assembly includes a sharpener slider top, a sharpener slider bottom located below the sharpener slider top, a reversed L-shaped stationary cradle located adjacent to the sharpener slider bottom and a biasing ember located between the sharpener slider bottom and the reversed L-shaped cradle in order to upwardly bias the sharpener slider bottom; and providing the adjustable sharpener assembly with a pair of abrasive stones oriented in a V-shaped configuration for defining a predetermined angle Ø for matingly receiving and sharpening the knife blade at a vertex of the angle Ø as the knife blade is slidingly passed through the vertically oriented bifurcated anterior enclosure and into the horizontally oriented bifurcated posterior enclosure for storage and for matingly receiving and sharpening the knife blade at the vertex of the angle Ø as the knife blade is slidingly extracted from the horizontally oriented bifurcated posterior enclosure and continuing sliding extraction from the vertically oriented bifurcated anterior enclosure until removed from the adjustable knife holder for use.

14. The method of manufacturing an adjustable knife holder adapted to maintain sharpness of a knife blade, as in claim 13, wherein the providing the adjustable sharpener assembly step is further comprised of the step of:

providing the sharpener slider top with a U-shaped block portion having a rear side, a bottom side, a beveled opening extending transversely through the U-shaped block portion and a pair of elongate, spaced-apart first rail members extending upwardly from the U-shaped block portion, wherein a front side of the pair of elongate, spaced-apart rail members is located adjacent to the rear side of the U-shaped block portion, wherein the pair of elongate, spaced-apart first rail members define a first gap there between, wherein the first gap is disposed in alignment with the beveled opening for accepting the knife blade through the opening and then through the first gap to facilitate knife blade sharpening purposes.

15. The method of manufacturing an adjustable knife holder adapted to maintain sharpness of a knife blade, as in claim 13, wherein the:

bifurcated housing includes an integrally attached locking mechanism for locking the horizontally oriented bifurcated posterior enclosure and the vertically oriented bifurcated anterior enclosure together in an assembled state and for unlocking the horizontally oriented bifurcated posterior enclosure and the vertically oriented bifurcated anterior enclosure from one another to facilitate their separation for knife holder adjustment purposes.

16. An adjustable knife holder, comprising:

a bifurcated housing having a horizontally oriented bifurcated posterior enclosure and a vertically oriented bifurcated anterior enclosure, wherein the horizontally oriented bifurcated posterior enclosure includes an interior volume and the vertically oriented bifurcated anterior enclosure includes a front end volume space, wherein the front end volume space has a sufficient volume for retaining in place and supporting therein an adjustable sharpener assembly, wherein the adjustable sharpener assembly includes a sharpener slider top, a sharpener slider bottom located below the sharpener slider top, a reversed L-shaped stationary cradle located adjacent to the sharpener slider bottom, and a biasing member located between the sharpener slider bottom and the reversed L-shaped cradle in order to upwardly bias the sharpener slider bottom, wherein the vertically oriented bifurcated anterior enclosure includes a magnetic base member disposed at a bottom of the front end volume space to facilitate an attraction of metal debris being sheared from a knife blade as the knife blade is inserted into the knife holder or as the knife blade is extracted from the knife holder.

17. The adjustable knife holder, as in claim 16, wherein the sharpener slider top includes a U-shaped block portion having a rear side, a bottom side, a beveled opening extending transversely through the U-shaped block portion and a pair of elongate, spaced-apart first rail members extending upwardly from the U-shaped block portion, wherein a front side of the pair of elongate, spaced-apart rail members is located adjacent to the rear side of the U-shaped block portion, wherein the pair of elongate, spaced-apart first rail members define a first gap there between, wherein the first gap is disposed in alignment with the beveled opening for accepting the knife blade through the opening and then through the the first gap to facilitate knife blade sharpening purposes.

18. The adjustable knife holder, as in claim 17, wherein the knife holder is further comprised of:

a sharpening stone support integrally attached to the rear side of the U-shaped block portion the sharpening stone support defining a generally V-shaped notch for removably receiving a first abrasive stone and a second abrasive stone, wherein the first abrasive stone and the second abrasive stone cooperate with one another to shear metal debris from the knife blade as the knife blade passes through the opening and then through the first gap.

19. The adjustable knife holder, as in claim 16, wherein the bifurcated housing further includes an integrally attached locking mechanism located along an upper portion of the horizontally oriented bifurcated posterior enclosure and adjacent to the vertically oriented bifurcated anterior enclosure.

* * * * *